United States Patent [19]

Yamamura et al.

[11] Patent Number: 4,470,828

[45] Date of Patent: Sep. 11, 1984

[54] AQUEOUS COAL SLURRY COMPOSITION

[75] Inventors: Masaaki Yamamura; Shinichi Watanabe, both of Wakayama; Yasuhiro Kiyonaga; Norio Fujii, both of Chiba, all of Japan

[73] Assignees: Kao Corporation; Lion Corporation, both of Tokyo, Japan

[21] Appl. No.: 458,920

[22] Filed: Jan. 18, 1983

[30] Foreign Application Priority Data

Jan. 19, 1982 [JP] Japan ..... 57-005333

[51] Int. Cl.[3] ..... C10L 1/32

[52] U.S. Cl. ..... 44/51

[58] Field of Search ..... 44/51; 406/92

[56] References Cited

U.S. PATENT DOCUMENTS

| | | | |
|---|---|---|---|
| 3,168,350 | 2/1965 | Phinney et al. | 44/51 |
| 3,762,887 | 10/1973 | Clancey et al. | 44/51 |
| 4,090,853 | 5/1978 | Clayfield et al. | 44/51 |
| 4,104,035 | 8/1978 | Cole et al. | 44/51 |
| 4,125,382 | 11/1978 | O'Brien | 44/51 |
| 4,187,078 | 2/1980 | Shimizu et al. | 44/51 |

*Primary Examiner*—Mrs. Y. Harris-Smith

*Attorney, Agent, or Firm*—Armstrong, Nikaido, Marmelstein & Kubovcik

[57] ABSTRACT

An aqueous coal slurry composition is provided which comprises:

(a) at least one compound selected from (a-1) a polyether polyol compound prepared by adding ethylene oxide and/or propylene oxide to an active hydrogen-containing compound, (a-2) a compound prepared by esterifying compound (a-1), (a-3) a compound prepared by phosphating, sulfating or carboxyalkylating compound (a-1) or a salt thereof, (a-4) a compound prepared by crosslinking compound (a-1) with a crosslinking agent, (a-5) a compound prepared by reacting compound (a-1) with epihalohydrin and (a-6) an isocyanate-terminated compound prepared by reacting compound (a-1) with a polyvalent isocyanate, (b) at least one surface active agent selected from (b-1) a sulfonation product of naphthalene or its salt or an aliphatic aldehyde addition condensate thereof, (b-2) an aliphatic aldehyde condensate of a sulfonic acid group-containing aminotriazine or its salt and (b-3) a sulfonation product of creosote oil or its salt or an aliphatic aldehyde addition condensate thereof, (c) water and (d) a coal powder.

The aqueous coal slurry has good fluidity and static stability.

12 Claims, 1 Drawing Figure

AQUEOUS COAL SLURRY COMPOSITION

BACKGROUND OF THE INVENTION

1. Field of the Invention

This invention relates to an aqueous coal slurry composition. More particularly, it relates to an aqueous slurry composition which is excellent in the dispersion stability and has such an excellent static stability that even if the composition is allowed to stand still for a long time, a hard cake of a dense and compact precipitate is not formed.

2. Description of the Prior Art

Petroleum has heretofore been used in largest quantities as the energy source, but because of limited oil deposits and attendant increase of the price of petroleum, it has recently been desired to use a variety of energy sources and maintain stable supply thereof. Under such circumstance, effective utilization of coal which is present all over the world with large quantities of deposits has been reconsidered. However, coal is solid unlike petroleum and impossible to transport through pipelines, and thus, handling of coal is disadvantageous. Furthermore, since coal contains a much larger amount of ash than petroleum, such trobules as reduction of the calorific value and disposal of fly ash arise. In order to eliminate the disadvantages in handling coal, various researches have been made on the method in which coal is powdered and dispersed in water and the resulting aqueous slurry is handled and used. However, this aqueous coal slurry is still not satisfactory in that if the coal concentration is increased, the viscosity is drastically increased and the fluidity is poor and, in contrast, if the coal concentration is reduced, the transportation efficiency is reduced and the dehydration step becomes expensive. Furthermore, it is difficult to find an optimum coal concentration. Namely, agglegation of coal particles is caused in an aqueous coal slurry to increase the viscosity and reduce the fluidity. As the size of coal particles in the aqueous slurry is smaller, the dispersion stability is better, but the pulverization cost increases with elevation of the degree of fine pulverization. Fine coal now used in thermal power plants has such a particle size that 80% of particles pass through a 200-mesh sieve, that is, a particle size of about 74 microns. Accordingly, it is expected that this particle size is used as one standard value of the particle size of fine coal.

When a surface active agent which is a dispersant is added to an aqueous coal slurry, the surface active agent is adsorbed in the interface between coal particles and water to exert functions of disentangling coal particles and prevent coal particles from agglegation. Accordingly, it is expected that addition of the surface active agent will produce a good dispersion state. We already proposed as such a dispersant a sulfonation product of a polycyclic aromatic compound which may contain a hydrocarbon group as a substituent or its salt (see Japanese Unexamined Patent Publication No. 21,636/81). When this dispersant is used, the fluidity is improved, but this dispersant is practically not satisfactory in that when a slurry containing this dispersant is allowed to stand still for a long time, a precipitate is formed and this precipitate becomes dense and compact to form a hard cake.

SUMMARY OF THE INVENTION

It is a primary object of the present invention to provide an aqueous coal slurry which has good fluidity and is excellent in static stability, namely, even if the aqueous coal slurry is allowed still for a long time, a hard cake is not formed.

In accordance with the present invention, there is provided an aqueous coal slurry composition comprising:

(a) at least one compound selected from the group consisting of (a-1) a polyether polyol compound prepared by adding 4 to 800 moles, on the average, of ethylene oxide and/or propylene oxide to a compound containing at least one active hydrogen atom in the molecule, (a-2) a compound prepared by partially or completely esterifying the hydroxyl groups of the compound (a-1), (a-3) a compound obtained by partially or completely phosphating, sulfating or carboxyalkylating the hydroxyl groups of the compound (a-1) or a salt thereof, (a-4) a compound prepared by crosslinking the compound (a-1) with a crosslinking agent, (a-5) a compound prepared by reacting the compound (a-1) with an epihalohydrin and (a-6) an isocyanate-terminated compound prepared by reacting the compound (a-1) with a polyvalent isocyanate, (b) at least one surface active agent selected from the group consisting of (b-1) a sulfonation product of naphthalene or its salt or an aliphatic aldehyde addition condensate thereof, (b-2) an aliphatic aldehyde condensate of a sulfonic acid group-containing aminotriazine or a salt thereof and (b-3) a sulfonation product of creosote oil or its salt or an aliphatic aldehyde addition condensate thereof, (c) water and (d) a coal powder.

DESCRIPTION OF THE PREFERRED EMBODIMENTS

Figure 1:
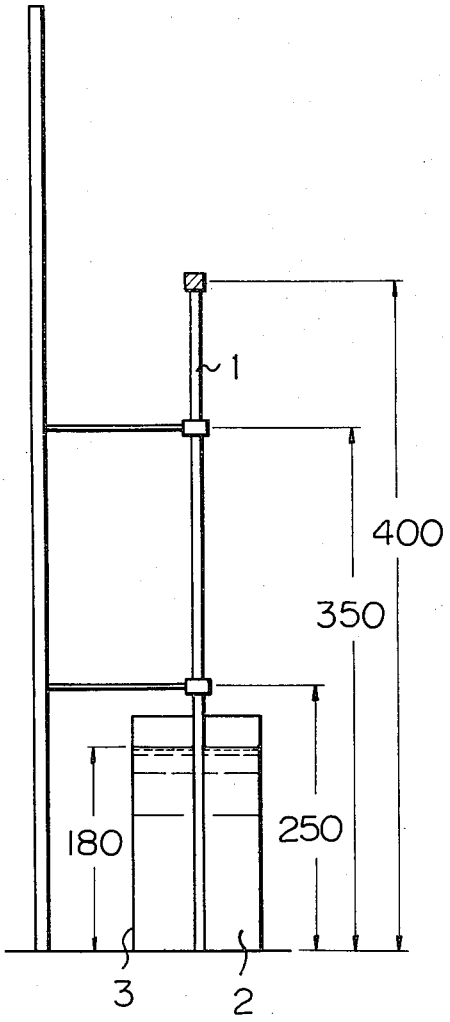
FIG. 1 shows a penetration test apparatus used for evaluation of the static stability of an aqueous coal slurry composition.

In the coal slurry composition of the present invention, it is preferred that the proportions of the respective components be such that the amount of the polymer as the component (a) is 0.001 to 2% by weight, more preferably 0.01 to 1% by weight, the amount of the surface active agent as the component (b) is 0.01 to 5% by weight, more preferably 0.1 to 1.0% by weight, the amount of water as the component (c) is 13 to 43% by weight, more preferably 20 to 35% by weight, and the amount of coal powder as the component (d) is 50 to 80% by weight, more preferably 65 to 80% by weight.

The polyether polyol compound component (a-1) in the present invention is prepared by addition-reacting ethylene oxide and/or propylene oxide with a compound containing at least one active hydrogen atom in the molecule, ordinarily in the presence of an acid or alkali catalyst under pressure, according to the customary procedures.

As the compound containing at least one hydrogen atom in the molecule, there can be mentioned monohydric alcohols such as lauryl alcohol and stearyl alcohol; polyhydric alcohols such as ethylene glycol, propylene glycol, butane diol, glycerin, trimethylol propane, pentaerythritol, sorbitane and sorbitol; aromatic compounds containing at least one hydroxyl group, such as phenol, octylphenol, nonylphenol, catechol, resorcinol, pyrogallol and a phenol-formaldehyde condensate; and amino compounds containing at least one active hydrogen atom, such as a primary amine, ethylene diamine, an N-alkylpropylene diamine, monoethanol amine, diethanol amine, triethanol amine, triethylene tetramine, tetraethylene pentamine and polyethylene imine. Furthermore, there can be mentioned compounds obtained by rendering cationic the foregoing amino compounds with an alkyl halide or diethyl sulfate. Among the foregoing compounds, compounds having at least three active hydrogen atoms in the molecule are preferred. Moreover, polyvinyl alcohol, partially saponified polyvinyl acetate and polymers containing units derived from a hydroxyl group-containing monomer may be used.

The polyether polyol compound as the component (a-1) of the present invention is prepared by adding ethylene oxide and/or propylene oxide to the above-mentioned compound containing at least one active hydrogen atoms in the molecule. However, in order to render this compound bulky and impart a coal particle-adsorbing property to this compound, at least 4 moles, on the average, of ethylene oxide and/or propylene oxide should be added. If the mole number of added ethylene oxide and/or propylene oxide is smaller than 4, the effect of stabilizing the dispersion is drastically reduced. The upper limit of the mole number is not particularly critical, but if the mole number is too large, the viscosity becomes too high and handling of the slurry becomes difficult, and the production comes to involve various troubles. Accordingly, it is preferred that the mole number be up to 800 on the average.

Addition of at least one of ethylene oxide and propylene oxide is indispensable. Butylene oxide may be added, so far as attainment of the intended effects is not hindered.

Furthermore, a compound prepared by adding an alkylene oxide to an amino compound such as mentioned above and rendering the addition product cationic with an alkyl halide or diethyl sulfate may effectively be used.

The stabilizing effect of the polyether polyol compound or its derivative as the component (a-1) of the present invention is especially excellent when ethylene oxide and/or propylene oxide are added in blocks, and a particularly excellent stabilizing effect is obtained when the content of the polyoxyethylene group in the polyether polyol chain is 20 to 80% by weight, especially 30 to 70% by weight.

The components (a-2) through (a-6) will now be described specifically.

The component (a-2) is prepared by partially or completely esterifying the hydroxyl groups of the polyether polyol with a carboxylic acid. Namely, this compound can be obtained by esterifying the above-mentioned polyether polyol compound with a monobasic carboxylic acid such as lauric acid or stearic acid or its functional derivative such as an anhydride or acid halide thereof according to customary procedures.

The component (a-3) is prepared by partially or completely phosphating, sulfating or carboxyalkylating the hydroxyl groups of the polyether polyol, or a salt thereof. Namely, this compound can be obtained by reacting the above-mentioned polyether polyol compound with a phosphating agent such as phosphorus pentoxide, a sulfating agent such as sulfur trioxide, chlorosulfonic acid or sulfamic acid or a carboxyalkylating agent such as monochloroacetic acid according to customary procedures. If the salt-forming reaction is further conducted, a salt of this compound can be obtained.

The component (a-4) is prepared by crosslinking the polyether polyol with a crosslinking agent. As the crosslinking agent, there can be mentioned polyvalent isocyanates such as hexamethylene diisocyanate, toluene diisocyanate and diphenylmethane diisocyanate; polyvalent epoxides such as diglycidyl bisphenol A and diglycidyl ethylene glycol; and polybasic carboxylic acids such as maleic anhydride, adipic acid, dimer acid and trimellitic anhydride.

The crosslinking agent is used for the reaction in an amount of 0.05 to 2 equivalents, preferably 0.1 to one equivalent, per the hydroxyl group in the polyether polyol compound. However, in the case where the polyether polyol compound contains at least three hydroxyl groups, the amount used of the crosslinking agent should be 0.1 to 0.5 equivalent.

The component (a-5) is prepared by reacting the polyether polyol with an epihalohydrin. Namely, this compound can be obtained by reacting the above-mentioned polyether polyol with an epihalohydrin such as epichlorohydrin or epibromohydrin, ordinarily in the presence of a metal catalyst such as tin, or an alkali, according to customary procedures. The amount of the epihalohydrin is not particularly critical and may be optional. However, a compound obtained by using the epihalohydrin in an amount equivalent to the terminal hydroxyl groups in the component (a-1) exerts a highest effect. Since this compound contains a terminal halohydrin or epoxy group, it is highly reactive and is very effective.

The component (a-6) is an isocyanate-terminated compound prepared by reacting the polyether polyol with a polyvalent isocyanate. This compound can be obtained by reacting the above-mentioned polyether polyol with a polyvalent isocyanate, but is is necessary to select conditions so that the crosslinking reaction is not advanced. Ordinarily, the compound is obtained by reacting the polyether polyol with a diisocyanate in an amount substantially equimolar to the hydroxyl groups in the polyether polyol compound and stopping the reaction in the midway. Since this compound contains reactive isocyanate groups on the molecule ends, the storage stability is sometimes insufficient. Accordingly, this compound may be protected with phenol, cresol, ϵ-caprolactam or acidic sodium sulfite so that the isocyanate groups can be regenerated during the process.

The surface active agent that is used as the component (b) in the present invention is a sulfonation product of naphthalene or creosote oil, its salt or an aliphatic aldehyde addition condensate thereof, or an aliphatic aldehyde condensate of a sulfonic acid group-containing aminotriazine or its salt. As the salt of the sulfonation product, there can be mentioned salts of alkali metals such as sodium and potassium, alkaline earth metals such as calcium and magnesium, ammonium and amines. The surface active agent may be a product obtained by addition-condensing the sulfonation product with an aliphatic aldehyde or product obtained by sulfonating an aliphatic aldehyde addition condensate. A product obtained by condensation with formaldehyde is preferred. The degree of condensation is preferably 1.2 to 30, more preferably 1.2 to 10. If the degree of condensation is lower than 1.2, the effect by condensation is low. In contrast, if the degree of condensation is higher than 30, the molecular weight is too high and the solubility is reduced.

By "creosote oil" used in the present invention is meant a neutral oil having a boiling point of at least 200° C., contained in coal dry distillation tar, and an alkylation product thereof. Various definitions have heretofore been made on creosote oil. According to JIS K-2439 (1978), creosote oil is defined as a mixture of middle oil and higher distillates, which is obtained by distillation of coal tar, and by "creosote oil" is meant a product obtained by separating crystals such as naphthalene and anthracene from respective distillates such as middle oil, heavy oil and anthracene oil, separating and recoverying phenols and pyridines and appropriately mixing the distillates to meet standard requirements. Products are grouped into three classes, No. 1, No. 2 and No. 3. For example, creosote oil No. 1 is a mixture of various compounds, which has a specific gravity of at least 1.03 and a water content of not more than 3% and comprises up to 25% of compounds having a boiling point of not higher than 235° C., and more than 40% of compounds having a boiling point of 235° to 315° C. More than 50% of creosote oil are compounds having a boiling point of not higher than 315° C.

As the starting material for the production of the component (b) of the present invention, there can be used creosote oils specified by JIS K-2439 (1978) in the form of a mixture of respective components, and fractions obtained by fractional distillation of these creosote oils, such as a fraction having a boiling point of 200° to 250° C., a fraction having a boiling point of 240° to 260° C., a fraction having a boiling point of 250° to 270° C. and a fraction having a boiling point of 270° to 300° C. Furthermore, alkylation products of the above-mentioned creosote oils and fractions can be used. The alkylation method is not particularly critical. There may be adopted a method in which sulfonation and alkylation are simultaneously carried out by conducting the sulfonation using fuming sulfuric acid or concentrated sulfuric acid in the presence of a corresponding alcohol.

The condensate of a sulfonic acid group-containing aminotriazine with an aliphatic aldehyde, which is used in the present invention, is an amino-S-triazine condensate, which is prepared, for example, according to the technique disclosed in Japanese Examined Patent Publication No. 21659/68. More specifically, the condensate is prepared by condensing an amino-S-triazine such as melamine, hexamethylol melamine, acetoguanamine or benzoguanamine in the presence of an aldehyde, preferably formaldehyde, and sulfonating the condensate with a sulfonating agent such as sulfurous acid, sulfuric acid, sulfonic acid, bisulfurous acid, a salt thereof, a disulfite, a dithionite or a pyrobisulfite, or by condensing an amino-S-triazine-sulfonic acid with an aldehyde, preferably formaldehyde. A sulfonated melamine resin, which is a preferred example of the component (b) of the present invention, is a sulfonic acid group-containing condensate obtained by reacting melamine with formaldehyde in the presence of $Na_2S_2O_3$ or $NaHSO_3$.

The amount of water incorporated as the component (c) in the coal slurry of the present invention is important. If the amount of water is too small, even when the components (a) and (b) are added, the dispersion stability is not improved and the resulting slurry has a poor fluidity. When water is added in an amount of at least 13% by weight, preferably at least 20% by weight, the dispersion stability is highly improved and the fluidity is enhanced. However, if water is incorporated in too large an amount, the calorific value is reduced and direct combustion becomes difficult. Accordingly, incorporation of too large an amount of water should be avoided. It is therefore preferred that water be incorporated in an amount of 13 to 43% by weight, more preferably 20 to 35% by weight.

The particle size of coal powder used as the component (d) in the present invention is to particularly critical. If coal powder is too coarse, the combustion efficiency is reduced. In contrast, if coal powder is too fine, the pulverization power is increased. Coal powder having such a particle size that 70 to 80% of the particles pass through a 200-mesh sieve is most preferred. Coal powder may be prepared by an optional pulverizer such as a ball mill, a colloidal mill or an attritor, and pulverization may be accomplished by the dry method or the wet method in water.

It is preferred that the coal concentration in the aqueous coal slurry composition be 50 to 80% by weight, more preferably 65 to 80% by weight. If the coal concentration is too low, the calorific value is reduced and direct combustion becomes difficult. In contrast, if the coal concentration is too high, the viscosity becomes too high and the fluidity is reduced. The above-mentioned concentration range is ordinarily preferred, though the preferred concentration varies to some extent according to the kind of coal and the particle size thereof. Any of anthracite, bituminous coal, sub-bituminous coal and brown coal may be used in the present invention.

If an electrolyte such as NaOH or $K_2CO_3$ is added to the slurry of the present invention, the dispersion stability is not degraded but sometimes improved.

The reason for which the aqueous coal slurry of the present invention has high fluidity and static stability cannot clearly be elucidated. However, it is believed that these excellent effects will probably be attained according to the following mechanism. The surface active agent used as the component (b) is an anionic surface active agent and it is greatly adsorbed on the carbonaceous substance in the coal particles in the aqueous coal slurry to impart charges thereto, whereby the dispersibility of the coal particles in the slurry is improved. However, if the component (b) alone is added, the precipitate becomes dense and compact to form a hard cake. If the component (a) is added together with the component (b), by the synergistic effect of these components, the fluidity is drastically improved, and with the lapse of time, a soft and loose floculate is formed by the coal particles and this soft and loose floculate results in formation of a soft precipitate having a good re-dispersibility. The viscous behavior of this soft and loose floculate is thixotropic, and under application of a shearing force, the soft and loose floculate is reversibly changed to a good dispersion state due to the component (b).

In preparing the aqueous coal slurry of the present invention, the order of addition of the components (a), (b), (c) and (d) is not particularly critical but optional. As pointed out hereinbefore, coal powder may be prepared by either the wet method or the dry method. For example, when wet pulverization in water is adopted, the components (a) and (b) may be added simultaneously, or there may be adopted a method in which the component (b) alone is first added and the component (a) is then added. Furthermore, a mixture of both the components (a) and (b) is prepared in advance and this mixture is added as a dispersion stabilizer.

The present invention will now be described in detail with reference to Synthesis Examples of some of the component (b) and Examples of the aqueous coal slurry of the present invention that by no means limit the scope of the present invention. Incidentally, in these Examples, all of "parts" and "%" are by weight.

SYNTHESIS EXAMPLE 1

[Sythesis of Component (b-2]

The pH value of 567 parts of 37% formalin was adjusted to 4.5 by adding caustic soda, and it was mixed with 294 parts of melamine. The mixture was heated at 75° C. to form a transparent solution. The solution was cooled to 45° C. and 222 parts of $Na_2S_2O_3$ was added thereto. Then, 332 parts of water was added to the mixture and the pH value was adjusted to 10.5 by adding caustic soda, and the solution was maintained at 80° C. for 2 hours. The solution was cooled to 50° C. and then mixed with a mixture comprising 2116 parts of water and 70 parts of concentrated sulfuric acid. Then, the reaction mixture was maintained at 50° C. for 5 hours, and the pH value was adjusted to 8.7 by adding caustic soda.

The solid content in the obtained solution was about 20% and the viscosity was 37 cP as measured at 25° C., and the obtained solution could be mixed with water at various ratios.

SYNTHESIS EXAMPLE 2

Synthesis of Component (b-2)]

The pH value of 567 parts of 37% formalin was adjusted to 4.5 by adding caustic soda, and it was mixed with 294 parts of melamine. The mixture was maintained at 75° C. to form a transparent solution. The solution was cooled and 222 parts of $Na_2S_2O_3$ was added thereto, and 332 parts of water was then added and the pH value was adjusted to 9.0 by adding caustic soda. The solution was maintained at 80° C. for 2 hours, and it was diluted with 2000 parts of water and then cooled. The viscosity of the obtained solution was 26.2 cP as measured at 25° C. and the solid content was about 20%.

SYNTHESIS EXAMPLE 3

[Sythesis of Component (b-2)]

Acetoguanamine-sulfonic acid was mixed with 30% formalin at a molar ratio of 1/4.0, and the mixture was maintained at 70° C. and the pH value was adjusted to 4.0 by adding caustic soda. Then, the mixture was heated at 90° C. for 2 hours. The viscosity of the obtained solution, which could be mixed with water at various ratios, was 346 cP as measured at 20° C., and the solid content of the solution was about 50%.

SYNTHESIS EXAMPLE 4

[Synthesis of Component (b-2)]

Benzoguanamine-sulfonic acid was mixed with 30% formalin at a molar ratio of 1/4.0, and the mixture was maintained at 70° C. and the pH value was adjusted to 4.0 by adding caustic soda. Then, the mixture was maintained at 90° C. for 2 hours. The viscosity of the obtained solution, which could be mixed with water at various ratios, was 2330 cP as measured at 20° C., and the solid content was about 50%.

EXAMPLE 1

(1) Preparation of Aqueous Coal Slurry:

Tatung coal (see the Table given below) was added as the component (d) to an aqueous solution containing a predetermined amount of the component (b) shown in Table 7 or 8 shown below or disclosed in the Synthesis Example, and the mixture was stirred at 5000 rpm for 5 minutes by a homogenizing mixer (supplied by Tokushu Kikako K.K.). Then, a predetermined amount of the component (a) shown in Table 1, 2, 3, 4, 5 or 6 was added to the mixture, and the resulting mixture was stirred at 5000 rpm for 2 minutes by the homogenizing mixer to form a coal slurry composition. Similarly, comparative aqueous coal slurries were prepared by adding comparative dispersion stabilizers instead of the components (a) and (b).

TABLE

| Properties of Component (d) | | | |
|---|---|---|---|
| Kind of Coal | Place of Production | Particle Size | Elementary Analysis Values |
| Tatung coal | China | 80% of particles passing through 200-mesh sieve | C = 77.9%, H = 4.5%, O = 7.0%, N = 0.9%, S = 0.7% |

(2) Evaluation of Fluidity and Static Stability:

The viscosity of the coal slurry composition prepared in (1) above was measured at 25° C. to evaluate the fluidity. A lower viscosity indicates a better fluidity.

The static stability was evaluated by using a penetration test apparatus having a structure and size as shown in FIG. 1. In FIG. 1, the dimensional unit of the height is mm. In a 500-cc graduated cylinder 3, the aqueous coal slurry 2 prepared in (1) above was allowed to stand, and after passage of 1 week, 2 weeks or 4 weeks, a time required for penetration of a glass rod 1 having a weight of 50 g was measured to evaluate the static stability. Namely, if the precipitate becomes dense and compact to form a hard cake, the penetration time is increased and in an extreme case, the glass rod is stopped in the midway. In the case where the static stability is good and the phase separation is not caused or where a precipitate is soft even if the phase separation takes place, the penetration time is short.

The obtained results are shown in Tables 9 and 10.

TABLE 1

| Examples of Compound (a-1) (Polyether Polyol Compound) | | | | | | | | |
|---|---|---|---|---|---|---|---|---|
| No. | Active Hydrogen-Containing Compound | Number of Functional Groups | Number of Added Moles EO(1) | Number of Added Moles PO(2) | EO Group Content (wt %) | Order of Addition(3) | Type of Addition | $\overline{M}w$ |
| a-1-1 | Propylene glycol | 2 | 10 | 50 | 13 | PO → EO | Block | 3400 |
| a-1-2 | " | 2 | 25 | 20 | 47 | " | " | 2300 |
| a-1-3 | " | 2 | 78 | 50 | 54 | " | " | 6300 |
| a-1-4 | Ethylene glycol | 2 | 65 | 0 | 100 | — | — | 2900 |
| a-1-5 | Glycerin | 3 | 10 | 32 | 18 | PO → EO | Block | 2400 |
| a-1-6 | " | 3 | 38 | 50 | 39 | " | " | 4700 |

TABLE 1-continued

Examples of Compound (a-1) (Polyether Polyol Compound)

| No. | Active Hydrogen-Containing Compound | Number of Functional Groups | Number of Added Moles EO(1) | Number of Added Moles PO(2) | EO Group Content (wt %) | Order of Addition(3) | Type of Addition | $\overline{M}w$ |
|---|---|---|---|---|---|---|---|---|
| a-1-7 | " | 3 | 68 | 50 | 50 | " | " | 6000 |
| a-1-8 | " | 3 | 68 | 50 | 50 | EO → PO | " | 6000 |
| a-1-9 | " | 3 | 68 | 50 | 50 | — | Random | 6000 |
| a-1-10 | " | 3 | 240 | 50 | 78 | PO → EO | Block | 13500 |
| a-1-11 | Pentaerythritol | 4 | 20 | 48 | 23 | " | " | 3800 |
| a-1-12 | " | 4 | 35 | 48 | 35 | " | " | 4500 |
| a-1-13 | " | 4 | 65 | 48 | 49 | " | " | 5800 |
| a-1-14 | " | 4 | 245 | 48 | 79 | " | " | 13700 |
| a-1-15 | " | 4 | 33 | 75 | 24 | " | " | 5900 |
| a-1-16 | " | 4 | 90 | 75 | 47 | " | " | 8400 |
| a-1-17 | Phenol-formalin condensate (4-nucleus product) | 4 | 8 | 21 | 21 | " | " | 1700 |
| a-1-18 | N—laurylpropylene diamine | 3 | 50 | 35 | 49 | " | " | 4500 |
| a-1-19 | Diethanol amine | 3 | 10 | 15 | 31 | " | " | 1400 |
| a-1-20 | " | 3 | 35 | 40 | 39 | " | " | 4000 |
| a-1-21 | Diethylsulfated diethanol amine | 3 | 70 | 40 | 56 | " | " | 5500 |

Note
(1)EO stands for ethylene oxide.
(2)PO stands for propylene oxide.
(3)PO →0 EO: PO was first added and EO was then added.
(4)EO → PO: EO was first added and PO was then added.

TABLE 2

Examples of Compound (a-2) (Esterification Product)

| a-2 No. | Base (a-1) Compound No. | Modification Method | Modification Ratio(1) |
|---|---|---|---|
| a-2-1 | a-1-2 | Acetic acid | 1/2 |
| a-2-2 | a-1-3 | Stearic acid | 1/2 |
| a-2-3 | a-1-4 | " | 1/2 |
| a-2-4 | a-1-7 | " | 1/3 |
| a-2-5 | a-1-7 | Oleic acid | 1/3 |
| a-2-6 | a-1-13 | Stearic acid | 1/4 |
| a-2-7 | a-1-13 | " | 3/4 |
| a-2-8 | a-1-13 | " | 4/4 |
| a-2-9 | a-1-19 | " | 2/3 |

Note
(1)The modification ratio indicates the functional group ratio ($CO_2H/OH$) in the compounds charged.

TABLE 3

Examples of Compound (a-3) (Anionic Compound)

| a-3-No. | Basa (a-1) Compound No. | Modification Method(1) | Modification Ratio(2) | Counter Ion |
|---|---|---|---|---|
| a-3-1 | a-1-1 | Phosphating | 1/6 | H |
| a-3-2 | a-1-5 | " | ⅓ | H |
| a-3-3 | a-1-7 | " | " | H |
| a-3-4 | a-1-7 | " | " | Na |
| a-3-5 | a-1-12 | " | " | H |
| a-3-6 | a-1-13 | " | " | H |
| a-3-7 | a-1-13 | " | " | Na |
| a-3-8 | a-1-15 | " | " | $NH_4$ |
| a-3-9 | a-1-20 | " | " | H |
| a-3-10 | a-1-3 | Sulfating | ½ | $NH_4$ |
| a-3-11 | a-1-6 | " | ⅔ | $NH_4$ |
| a-3-12 | a-1-7 | " | ⅔ | $NH_4$ |
| a-3-13 | a-1-7 | " | ⅔ | Na |
| a-3-14 | a-1-11 | " | 2/4 | $NH_4$ |
| a-3-15 | a-1-13 | " | 2/4 | $NH_4$ |
| a-3-16 | a-1-13 | " | 2/4 | Na |
| a-3-17 | a-1-14 | " | ¼ | $NH_4$ |
| a-3-18 | a-1-17 | " | ¼ | $NH_4$ |
| a-3-19 | a-1-18 | " | ⅓ | $NH_4$ |
| a-3-20 | a-1-20 | " | ⅓ | Na |
| a-3-21 | a-1-2 | Carboxymethylating | ½ | Na |
| a-3-22 | a-1-3 | " | ½ | " |
| a-3-23 | a-1-4 | " | ½ | " |
| a-3-24 | a-1-7 | " | ⅔ | " |
| a-3-25 | a-1-7 | " | 3/3 | " |
| a-3-26 | a-3-13 | " | ¼ | " |
| a-3-27 | a-3-13 | " | 2/4 | " |
| a-3-28 | a-3-13 | " | 2/4 | H |

TABLE 3-continued

Examples of Compound (a-3) (Anionic Compound)

| a-3-No. | Basa (a-1) Compound No. | Modification Method(1) | Modification Ratio(2) | Counter Ion |
|---|---|---|---|---|
| a-3-29 | a-3-13 | " | 4/4 | Na |
| a-3-30 | a-3-13 | " | 4/4 | H |
| a-3-31 | a-3-19 | " | ⅓ | Na |
| a-3-32 | a-3-19 | " | ⅓ | $NH_4$ |

Note
(1)a-3-1 through a-3-9: phosphating modification
a-3-10 through a-3-20: sulfating modification
a-3-21 through a-3-32: carboxymethylating modification
(2)The modification ratio indicates the functional group ratio ($P_2O_5/OH$, $OSO_3M/OH$ or $CH_2COOM/OH$) in the compounds charged.

TABLE 4

Examples of Compound (a-4) (Crosslinked Compound)

| a-4-No. | Bases (a-1) Compound No. | Modification Method(1) | Modification Ratio(2) |
|---|---|---|---|
| a-4-1 | a-1-3 | Toluene diisocyanate | 2/2 |
| a-4-2 | a-1-7 | " | 1/3 |
| a-4-3 | a-1-7 | Hexamethylene diisocyanate | 1/3 |
| a-4-4 | a-1-11 | Toluene diisocyanate | 1/4 |
| a-4-5 | a-1-13 | " | 1/4 |
| a-4-6 | a-1-13 | Hexamethylene diisocyanate | 1/4 |
| a-4-7 | a-1-13 | Diphenylmethane diisocyanate | 1/4 |
| a-4-8 | a-1-14 | Toluene diisocyanate | 1/4 |
| a-4-9 | a-1-20 | " | 1/3 |
| a-4-10 | a-1-3 | Diglycidyl bisphenol A | 2/2 |
| a-4-11 | a-1-7 | " | 1/3 |
| a-4-12 | a-1-13 | " | 1/4 |
| a-4-13 | a-1-13 | Diglycidyl ethylene glycol | 1/4 |
| a-4-14 | a-1-7 | Adipic acid | 1/3 |
| a-4-15 | a-1-13 | " | 1/4 |
| a-4-16 | a-1-13 | Dimer acid | 1/4 |

Note
(1)a-4-1 through a-4-9: iscocyanate crosslinking
a-4-10 through a-4-13: epihalohydrin crosslinking
a-4-14 through a-4-16: ester crosslinking
(2)The modification ratio indicates the functional group ratio (NCO/OH, $-\underset{\diagdown\ \diagup}{CH}-CH_2/OH$ or $CO_2H/OH$) in the compounds charged.

TABLE 5

Examples of Compound (a-5) (Epihalohydrin Reaction Product)

| a-5-No. | Base (a-1) Compound No. | Modifier | Modification Ratio(1) |
|---|---|---|---|
| a-5-1 | a-1-3 | Epichlorohydrin | 1 |
| a-5-2 | a-1-6 | " | 1 |
| a-5-3 | a-1-7 | " | 1 |
| a-5-4 | a-1-7 | " | 2/3 |
| a-5-5 | a-1-8 | " | 1 |
| a-5-6 | a-1-11 | " | 1 |
| a-5-7 | a-1-12 | " | 1 |
| a-5-8 | a-1-13 | " | 3/4 |
| a-5-9 | a-1-13 | " | 2/4 |
| a-5-10 | a-1-13 | Epibromohydrin | 1 |
| a-5-11 | a-1-14 | Epichlorohydrin | 1 |
| a-5-12 | a-1-17 | " | 1 |
| a-5-13 | a-1-18 | " | 1 |
| a-5-14 | a-1-20 | " | 1 |

Note
(1)The modification ratio indicates the functional group ratio $-\underset{\underset{O}{\backslash\,/}}{CH}-CH_2/OH$ in the compounds charged.

TABLE 6

Examples of Compound (a-6) (Isocyanate Reaction Product)

| a-6-No. | Base (a-1) Compound No. | Modifier | Blocking Agent(2) | Modification Ratio(1) |
|---|---|---|---|---|
| a-6-1 | a-1-1 | Toluene diisocyanate | — | 4/2 |
| a-6-2 | a-1-3 | Toluene diisocyanate | — | 4/2 |
| a-6-3 | a-1-3 | Toluene diisocyanate | A | 4/2 |
| a-6-4 | a-1-3 | Toluene diisocyanate | B | 4/2 |
| a-6-5 | a-1-7 | Toluene diisocyanate | — | 6/3 |

TABLE 6-continued

Examples of Compound (a-6) (Isocyanate Reaction Product)

| a-6-No. | Base (a-1) Compound No. | Modifier | Blocking Agent(2) | Modification Ratio(1) |
|---|---|---|---|---|
| a-6-6 | a-1-13 | Toluene diisocyanate | — | 8/4 |
| a-6-7 | a-1-13 | Toluene diisocyanate | A | 8/4 |
| a-6-8 | a-1-13 | Toluene diisocyanate | B | 8/4 |
| a-6-9 | a-1-13 | Hexamethylene diisocyanate | — | 8/4 |
| a-6-10 | a-1-20 | Toluene diisocyanate | — | 6/3 |

Note
(1)The modification ratio indicates the functional group ratio (NCO/OH) in the compounds charged.
(2)A: acidic sodium sulfite
B: -caprolactam

TABLE 7

Examples of Component (b-1)

| (b-1) Component No. | Compound | |
|---|---|---|
| b-1-(1) | Sodium naphthalene sulfonate | |
| b-1-(2) | Formalin condensate of b-1-(1) | (condensation degree of 2) |
| b-1-(3) | " | (condensation degree of 4) |
| b-1-(4) | " | (condensation degree of 8) |
| b-1-(5) | Naphthalene-sulfonic acid | |
| b-1-(6) | Formalin condensate of b-1-(5) | (condensation degree of 2) |
| b-1-(7) | " | (condensation degree of 4) |
| b-1-(8) | " | (condensation degree of 8) |

TABLE 8

Examples of Component (b-3)

| (b-3) Component No. | Compound |
|---|---|
| b-3-(1) | Sulfonation product of creosote oil* (Na salt) |
| b-3-(2) | Formalin condensate of b-3-(1) (condensation degree of 2) |
| b-3-(3) | Formalin condensate of b-3-(1) (condensation degree of 4) |
| b-3-(4) | Formalin condensate of b-3-(1) (condensation degree of 6) |
| b-3-(5) | Sulfonation product of butylated creosote oil (Na salt) |
| b-3-(6) | Formalin condensate of b-3-(5) (condensation degree of 2) |
| b-3-(7) | Sulfonation product of hexylated creosote oil (Na salt) |
| b-3-(8) | Formalin condensate of b-3-(11) (condensation degree of 4) |
| b-3-(9) | Sulfonation product (Na salt) of formalin condensate of creosote oil (condensation degree of 3) |
| b-3-(10) | Sulfonation product (Na salt) of mixture of creosote oil and napthalene (weight ratio = 1:1) |
| b-3-(11) | Formalin condensate (Na salt) (condensation degree of 4) of sulfonation product (Na salt) of mixture of creosote oil and butylnapthalene (weight ratio = 1:1) |
| b-3-(12) | Formalin condensate of b-3-(10) (condensation degree of 4) |

Note
*Creosote oil No. 1

TABLE 9

| No. | Component (a) | Component (b) | Mixing Ratio (weight ratio) a/b/c/d | Fluidity: Viscosity(1) (cP) | Fluidity: E-valuation(2) | Static Stability (Rod Penetration Time)(3): After 1 Week | After 2 Weeks | After 4 Weeks | E-valuation(2) |
|---|---|---|---|---|---|---|---|---|---|
| Comparative Examples | | | | | | | | | |
| 1 | — | — | 0/0/30/70 | Above 20,000 | x | —(4) | — | — | — |
| 2 | — | Sodium dodecyl- | 0/0.35/29.65/70 | " | " | — | — | — | — |

TABLE 9-continued

| No. | Component (a) | Component (b) | Mixing Ratio (weight ratio) a/b/c/d | Fluidity Viscosity(1) (cP) | Fluidity E-valuation(2) | Static Stability (Rod Penetration Time)(3) After 1 Week | After 2 Weeks | After 4 Weeks | E-valuation(2) |
|---|---|---|---|---|---|---|---|---|---|
| | | benzene-sulfonate | | | | | | | |
| 3 | — | Sodium oleate | " | " | " | — | — | — | — |
| 4 | — | Sodium oleyl sulfate | " | " | " | — | — | — | — |
| 5 | — | POE (10 moles) nonylphenyl ether | " | " | " | — | — | — | — |
| 6 | — | b-1-(3) | " | 2,250 | o | Not penetrating | | | |
| 7 | — | b-1-(4) | " | 2,100 | o | Not penetrating | | | |
| 8 | — | b-1-(6) | " | 2,560 | o | Not penetrating | | | |
| 9 | — | b-2 obtained in Synthesis Example 1 | " | 2,620 | o | Not penetrating | | | |
| 10 | — | b-2 obtained in Synthesis Example 3 | " | 2,680 | o | Not penetrating | | | |
| 11 | — | b-3-(1) | " | 3,950 | o | Not penetrating | | | |
| 12 | — | b-3-(3) | " | 2,050 | o | Not penetrating | | | |
| 13 | — | b-3-(6) | " | 2,040 | o | Not penetrating | | | |
| 14 | — | b-3-(9) | " | 2,340 | o | Not penetrating | | | |
| 15 | — | b-3-(11) | " | 2,070 | o | Not penetrating | | | |
| Comparative Samples | | | | | | | | | |
| 16 | Sodium dodecyl-benzene-sulfonate | b-1-(4) | 0.07/0.35/29.58/70 | 2,450 | o | Not penetrating | | | |
| 17 | Sodium oleate | " | " | 2,560 | o | Not penetrating | | | |
| 18 | Sodium oleyl sulfate | " | " | 2,620 | o | Not penetrating | | | |
| 19 | POE (10 moles) nonylphenyl ether | " | " | 2,590 | o | Not penetrating | | | |
| 20 | a-1-1 | — | 0.07/0/29.93/70 | Above 20,000 | x | — | — | — | — |
| 21 | a-1-5 | — | " | " | " | — | — | — | — |
| 22 | a-1-10 | — | " | " | " | — | — | — | — |
| 23 | a-1-20 | — | " | " | " | — | — | — | — |
| 24 | a-2-1 | — | " | " | " | — | — | — | — |
| 25 | a-2-5 | — | " | " | " | — | — | — | — |
| 26 | a-2-9 | — | " | " | " | — | — | — | — |
| 27 | a-3-1 | — | " | " | " | — | — | — | — |
| 28 | a-3-10 | — | " | " | " | — | — | — | — |
| 29 | a-3-20 | — | " | " | " | — | — | — | — |
| 30 | a-3-30 | — | " | " | " | — | — | — | — |
| 31 | a-4-1 | — | " | " | " | — | — | — | — |
| 32 | a-4-10 | — | " | " | " | — | — | — | — |
| 33 | a-4-20 | — | " | " | " | — | — | — | — |
| 34 | a-5-1 | — | " | " | " | — | — | — | — |
| 35 | a-5-10 | — | " | " | " | — | — | — | — |
| 36 | a-5-20 | — | " | " | " | — | — | — | — |
| 37 | a-5-30 | — | " | " | " | — | — | — | — |
| 38 | a-6-1 | — | " | " | " | — | — | — | — |
| 39 | a-6-10 | — | " | " | " | — | — | — | — |
| 40 | a-6-20 | — | " | " | " | — | — | — | — |
| 41 | a-1-1 | — | 0.35/0/29.65/70 | 9,000 | Δ | 60 | Not penetrating | | Δ |
| 42 | " | — | 0.7/0/29.3/70 | 7,500 | Δ | 79 | Not | | Δ |

TABLE 9-continued

| No. | Component (a) | Component (b) | Mixing Ratio (weight ratio) a/b/c/d | Fluidity Viscosity(1) (cP) | Fluidity E-valuation(2) | Static Stability (Rod Penetration Time)(3) After 1 Week | After 2 Weeks | After 4 Weeks | E-valuation(2) |
|---|---|---|---|---|---|---|---|---|---|
| | | | | | | penetrating | | | |

Note
(1)Viscosity as measured at 25° C.
(2)o: good, Δ: slightly good, x: poor
(3)Each numerical value indicates the number of seconds, and "not penetrating" indicates that the glass rod stopped in the midway.
(4)When the viscosity was above 20,000, the stability was not evaluated.

TABLE 10

| No. | Component (a) | Component (b) | Mixing Ratio a/b/c/d | Fluidity Viscosity(1) (cp) | Fluidity Evaluation(2) | Static Stability (Rod Penetration Time)(3) After 1 Week | After 2 Weeks | After 4 Weeks | Evaluation(2) |
|---|---|---|---|---|---|---|---|---|---|
| Samples of Present Invention | | | | | | | | | |
| 1 | a-1-10 | b-1-(1) | 0.07/0.35/29.58/70 | 2,520 | o | 1 | 1 | 2 | o |
| 2 | " | b-1-(2) | " | 1,520 | o | 1 | 1 | 3 | o |
| 3 | " | b-1-(3) | " | 1,200 | o | 1 | 1 | 2 | o |
| 4 | " | b-1-(4) | " | 880 | o | 1 | 1 | 2 | o |
| 5 | " | b-1-(5) | " | 2,560 | o | 1 | 1 | 2 | o |
| 6 | " | b-1-(6) | " | 1,100 | o | 1 | 1 | 2 | o |
| 7 | " | b-1-(7) | " | 1,050 | o | 1 | 1 | 3 | o |
| 8 | " | b-1-(8) | " | 1,090 | o | 1 | 1 | 2 | o |
| 9 | " | Product of Synthesis Example 1 | " | 1,430 | o | 1 | 1 | 2 | o |
| 10 | " | Product of Synthesis Example 2 | " | 1,390 | o | 1 | 1 | 2 | o |
| 11 | " | Product of Synthesis Example 3 | " | 1,420 | o | 1 | 1 | 2 | o |
| 12 | " | b-3-(1) | " | 2,560 | o | 1 | 1 | 2 | o |
| 13 | " | b-3-(2) | " | 1,480 | o | 1 | 1 | 2 | o |
| 14 | " | b-3-(3) | " | 1,520 | o | 1 | 1 | 2 | o |
| 15 | " | b-3-(4) | " | 1,100 | o | 1 | 1 | 3 | o |
| 16 | " | b-3-(5) | " | 2,450 | o | 1 | 1 | 2 | o |
| 17 | " | b-3-(6) | " | 1,420 | o | 1 | 1 | 2 | o |
| 18 | " | b-3-(7) | " | 3,570 | o | 1 | 1 | 2 | o |
| 19 | " | b-3-(8) | " | 1,430 | o | 1 | 1 | 2 | o |
| 20 | " | b-3-(9) | " | 1,240 | o | 1 | 1 | 2 | o |
| 21 | " | b-3-(10) | " | 3,400 | o | 1 | 1 | 2 | o |
| 22 | " | b-3-(11) | " | 1,380 | o | 1 | 1 | 2 | o |
| 23 | " | b-3-(12) | " | 1,150 | o | 1 | 1 | 2 | o |
| 24 | a-1-1 | b-1-(4) | " | 930 | o | 1 | 1 | 3 | o |
| 25 | a-1-2 | " | " | 910 | o | 1 | 1 | 3 | o |
| 26 | a-1-3 | " | " | 970 | o | 1 | 1 | 2 | o |
| 27 | a-1-4 | " | " | 950 | o | 1 | 1 | 2 | o |
| 28 | a-1-5 | " | " | 1,000 | o | 1 | 1 | 2 | o |
| 29 | a-1-6 | " | " | 1,020 | o | 1 | 1 | 2 | o |
| 30 | a-1-7 | " | " | 890 | o | 1 | 1 | 3 | o |
| 31 | a-1-8 | " | " | 900 | o | 1 | 1 | 3 | o |
| 32 | a-1-9 | " | " | 940 | o | 1 | 1 | 3 | o |
| 33 | a-1-11 | " | " | 940 | o | 1 | 1 | 2 | o |
| 34 | a-1-12 | " | " | 930 | o | 1 | 1 | 2 | o |
| 35 | a-1-13 | " | " | 970 | o | 1 | 1 | 2 | o |
| 36 | a-1-14 | " | " | 940 | o | 1 | 1 | 2 | o |
| 37 | a-1-15 | b-1-(4) | " | 860 | o | 1 | 1 | 2 | o |
| 38 | a-1-16 | " | " | 920 | o | 1 | 1 | 2 | o |
| 39 | a-1-17 | " | " | 1,050 | o | 1 | 1 | 3 | o |
| 40 | a-1-18 | " | " | 1,040 | o | 1 | 1 | 2 | o |
| 41 | a-1-19 | " | " | 1,010 | o | 1 | 1 | 2 | o |
| 42 | a-1-20 | " | " | 1,150 | o | 1 | 1 | 2 | o |
| 43 | a-1-21 | " | " | 920 | o | 1 | 1 | 2 | o |
| 44 | a-2-1 | " | " | 930 | o | 1 | 1 | 2 | o |
| 45 | a-2-2 | " | " | 910 | o | 1 | 1 | 3 | o |
| 46 | a-2-3 | " | " | 1,040 | o | 1 | 1 | 3 | o |
| 47 | a-2-4 | " | " | 1,070 | o | 1 | 1 | 3 | o |
| 48 | a-2-5 | " | " | 970 | o | 1 | 1 | 3 | o |
| 49 | a-2-6 | " | " | 990 | o | 1 | 1 | 2 | o |
| 50 | a-2-7 | " | " | 980 | o | 1 | 1 | 2 | o |
| 51 | a-2-8 | " | " | 940 | o | 1 | 1 | 2 | o |
| 52 | a-2-9 | " | " | 1,000 | o | 1 | 1 | 2 | o |
| 53 | a-3-1 | " | " | 1,100 | o | 1 | 1 | 2 | o |
| 54 | a-3-2 | " | " | 1,020 | o | 1 | 1 | 2 | o |
| 55 | a-3-3 | b-1-(4) | " | 1,040 | o | 1 | 1 | 2 | o |
| 56 | a-3-4 | " | " | 950 | o | 1 | 1 | 2 | o |

TABLE 10-continued

| No. | Component (a) | Component (b) | Mixing Ratio a/b/c/d | Fluidity Viscosity(1) (cp) | Fluidity Evaluation(2) | Static Stability (Rod Penetration Time)(3) After 1 Week | After 2 Weeks | After 4 Weeks | Evaluation(2) |
|---|---|---|---|---|---|---|---|---|---|
| 57 | a-3-5 | " | " | 970 | o | 1 | 1 | 2 | o |
| 58 | a-3-6 | " | " | 890 | o | 1 | 1 | 2 | o |
| 59 | a-3-7 | " | " | 900 | o | 1 | 1 | 3 | o |
| 60 | a-3-8 | " | " | 1,020 | o | 1 | 1 | 3 | o |
| 61 | a-3-9 | " | " | 1,040 | o | 1 | 1 | 2 | o |
| 62 | a-3-10 | " | " | 1,100 | o | 1 | 1 | 2 | o |
| 63 | a-3-11 | " | " | 1,060 | o | 1 | 1 | 2 | o |
| 64 | a-3-12 | " | " | 1,070 | o | 1 | 1 | 2 | o |
| 65 | a-3-13 | " | " | 1,080 | o | 1 | 1 | 2 | o |
| 66 | a-3-14 | " | " | 980 | o | 1 | 1 | 2 | o |
| 67 | a-3-15 | " | " | 970 | o | 1 | 1 | 2 | o |
| 68 | a-3-16 | " | " | 960 | o | 1 | 1 | 3 | o |
| 69 | a-3-17 | " | " | 930 | o | 1 | 1 | 3 | o |
| 70 | a-3-18 | " | " | 1,020 | o | 1 | 1 | 2 | o |
| 71 | a-3-19 | " | " | 1,040 | o | 1 | 1 | 2 | o |
| 72 | a-3-20 | " | " | 1,050 | o | 1 | 1 | 2 | o |
| 73 | a-3-21 | " | " | 1,120 | o | 1 | 1 | 2 | o |
| 74 | a-3-22 | b-1-(4) | " | 990 | o | 1 | 1 | 2 | o |
| 75 | a-3-23 | " | " | 980 | o | 1 | 1 | 2 | o |
| 76 | a-3-24 | " | " | 1,010 | o | 1 | 1 | 3 | o |
| 77 | a-3-25 | " | " | 1,300 | o | 1 | 1 | 3 | o |
| 78 | a-3-26 | " | " | 1,150 | o | 1 | 1 | 3 | o |
| 79 | a-3-27 | " | " | 1,200 | o | 1 | 1 | 2 | o |
| 80 | a-3-28 | " | " | 1,060 | o | 1 | 1 | 2 | o |
| 81 | a-3-29 | " | " | 970 | o | 1 | 1 | 2 | o |
| 82 | a-3-30 | " | " | 980 | o | 1 | 1 | 2 | o |
| 83 | a-3-31 | " | " | 1,000 | o | 1 | 1 | 3 | o |
| 84 | a-3-32 | " | " | 940 | o | 1 | 1 | 3 | o |
| 85 | a-4-1 | " | " | 960 | o | 1 | 1 | 3 | o |
| 86 | a-4-2 | " | " | 990 | o | 1 | 1 | 3 | o |
| 87 | a-4-3 | " | " | 1,020 | o | 1 | 1 | 2 | o |
| 88 | a-4-4 | " | " | 1,040 | o | 1 | 1 | 2 | o |
| 89 | a-4-5 | " | " | 1,100 | o | 1 | 1 | 2 | o |
| 90 | a-4-6 | " | " | 1,250 | o | 1 | 1 | 2 | o |
| 91 | a-4-7 | " | " | 1,120 | o | 1 | 1 | 2 | o |
| 92 | a-4-8 | " | " | 1,060 | o | 1 | 1 | 3 | o |
| 93 | a-4-9 | b-1-(4) | " | 1,000 | o | 1 | 1 | 3 | o |
| 94 | a-4-10 | " | " | 1,200 | o | 1 | 1 | 2 | o |
| 95 | a-4-11 | " | " | 1,310 | o | 1 | 1 | 2 | o |
| 96 | a-4-12 | " | " | 1,010 | o | 1 | 1 | 2 | o |
| 97 | a-4-13 | " | " | 1,050 | o | 1 | 1 | 3 | o |
| 98 | a-4-14 | " | " | 990 | o | 1 | 1 | 3 | o |
| 99 | a-4-15 | " | " | 890 | o | 1 | 1 | 2 | o |
| 100 | a-4-16 | " | " | 1,090 | o | 1 | 1 | 2 | o |
| 101 | a-5-1 | " | " | 870 | o | 1 | 1 | 2 | o |
| 102 | a-5-2 | " | " | 1,060 | o | 1 | 1 | 3 | o |
| 103 | a-5-3 | " | " | 1,100 | o | 1 | 1 | 2 | o |
| 104 | a-5-4 | " | " | 1,050 | o | 1 | 1 | 2 | o |
| 105 | a-5-5 | " | " | 1,000 | o | 1 | 1 | 2 | o |
| 106 | a-5-6 | " | " | 990 | o | 1 | 1 | 3 | o |
| 107 | a-5-7 | " | " | 960 | o | 1 | 1 | 3 | o |
| 108 | a-5-8 | " | " | 1,020 | o | 1 | 1 | 3 | o |
| 109 | a-5-9 | " | " | 1,050 | o | 1 | 1 | 2 | o |
| 110 | a-5-10 | " | " | 1,000 | o | 1 | 1 | 2 | o |
| 111 | a-5-11 | " | " | 1,200 | o | 1 | 1 | 2 | o |
| 112 | a-5-12 | b-1-(4) | " | 1,100 | o | 1 | 1 | 2 | o |
| 113 | a-5-13 | " | " | 1,060 | o | 1 | 1 | 2 | o |
| 114 | a-5-14 | " | " | 1,500 | o | 1 | 1 | 2 | o |
| 115 | a-6-1 | " | " | 1,420 | o | 1 | 1 | 2 | o |
| 116 | a-6-2 | " | " | 1,000 | o | 1 | 1 | 2 | o |
| 117 | a-5-3 | " | " | 1,320 | o | 1 | 1 | 2 | o |
| 118 | a-6-4 | " | " | 1,300 | o | 1 | 1 | 3 | o |
| 119 | a-6-5 | " | " | 990 | o | 1 | 1 | 3 | o |
| 120 | a-6-6 | " | " | 980 | o | 1 | 1 | 3 | o |
| 121 | a-6-7 | " | " | 890 | o | 1 | 1 | 3 | o |
| 122 | a-6-8 | " | " | 900 | o | 1 | 1 | 2 | o |
| 123 | a-6-9 | " | " | 920 | o | 1 | 1 | 2 | o |
| 124 | a-6-10 | " | " | 1,040 | o | 1 | 1 | 2 | o |
| 125 | a-1-1 | b-1-(4) | 0.007/0.35/29.643/70 | 1,050 | o | 1 | 1 | 2 | o |
| 126 | " | " | 0.035/0.35/29.615/70 | 1,000 | o | 1 | 1 | 2 | o |
| 127 | " | " | 0.35/0.35/29.3/70 | 1,240 | o | 1 | 1 | 2 | o |
| 128 | " | " | 0.07/0.07/29.86/70 | 5,060 | o | 1 | 1 | 2 | o |

TABLE 10-continued

| No. | Component (a) | Component (b) | Mixing Ratio a/b/c/d | Fluidity Viscosity(1) (cp) | Fluidity Evaluation(2) | Static Stability (Rod Penetration Time)(3) After 1 Week | After 2 Weeks | After 4 Weeks | Evaluation(2) |
|---|---|---|---|---|---|---|---|---|---|
| 129 | " | " | 0.07/0.7/29.23/70 | 750 | o | 1 | 1 | 2 | o |

Note
(1)Viscosity as measured at 25° C.
(2)o: good,
Δ: slightly good,
x: poor
(3)Each value indicates the number of seconds, and "not penetrating" indicates that the glass rod stopped in the midway.

We claim:

1. An aqueous coal slurry composition comprising:

(a) at least one compound selected from the group consisting of (1) a polyether polyol compound prepared by adding 4 to 800 moles, on the average, of ethylene oxide and/or propylene oxide to a compound containing at least one active hydrogen atom in the molecule, (2) a compound prepared by partially or completely esterifying the hydroxyl groups of the compound (1), (3) a compound prepared by partially or completely phosphating, sulfating or carboxyalkylating the hydroxyl groups of the compound (1) or a salt thereof, (4) a compound prepared by crosslinking the compound (1) with a crosslinking agent, (5) a compound prepared by reacting the compound (1) with an epihalohydrin and (6) an isoyanate-terminated compound prepared by reacting the compound (1) with a polyvalent isocyanate.

(b) at least one surface active agent selected from the group consisting of (1) a sulfonation product of naphthalene or its salt or an aliphatic aldehyde addition condensate thereof, (2) an aliphatic aldehyde condensate of a sulfonic acid group-containing aminotriazine or a salt thereof and (3) a sulfonation product of creosote oil or its salt or an aliphatic aldehyde addition condensate thereof, (c) water, and (d) a coal powder.

2. An aqueous coal slurry composition according to claim 1, wherein the amount of the component (a) is 0.001 to 2% by weight, the amount of the component (b) is 0.01 to 5% by weight, the amount of the component (c) is 13 to 43% by weight and the amount of the component (d) is 50 to 80% by weight, based on the weight of the aqueous coal slurry composition.

3. An aqueous coal slurry composition according to claim 1, wherein the amount of the component (a) is 0.01 to 1% by weight, the amount of the component (b) is 0.1 to 1.0% by weight, the amount of the component (c) is 20 to 35% by weight and the amount of the component (d) is 65 to 80% by weight, based on the weight of the aqueous coal slurry composition.

4. An aqueous coal slurry composition according to claim 1, wherein said polyether polyol compound is prepared by adding 4 to 800 moles, on the average, of ethylene oxide and/or propylene oxide to a compound containing at least three active hydrogen atom in the molecule.

5. An aqueous coal slurry composition according to claim 1, wherein the content of the polyoxyethylene group in the polyether chain of said polyether polyol compound is 20 to 80% by weight.

6. An aqueous coal slurry composition according to claim 1, wherein said component (a) (2), is prepared by partially or completely esterifying the hydroxyl groups of the comonent (a) (1) with a monobasic carboxylic acid or its functional derivative.

7. An aqueous coal slurry composition according to claim 1, wherein said component (a) (4) is prepared by crosslinking the component (a) (1) with 0.05 to 2 equivalents, per the hydroxyl group in the component (1), of a crosslinking agent selected from the group consisting of polyvalent isocyanates, and polyvalent epoxides and polybasic carboxylic acids.

8. An aqueous coal slurry composition according to claim 1, wherein said component (a) (5) is prepared by reacting the component (a) (1) with a substantially equivalent amount of an epihalohydrin to the terminal hydroxyl groups in the component (1).

9. An aqueous coal slurry composition according to claim 1, wherein said component (a) (6) is prepared by reacting the polyether polyol compound with a diisocyanate in an amount substantially equimolar to the hydroxyl groups in the polyether polyol compound and stopping the reaction in the midway.

10. An aqueous coal slurry according to claim 1, wherein the aliphatic aldehyde in said component (b) is formaldehyde.

11. An aqueous coal slurry according to claim 1, wherein the degree of condensation in said aliphatic aldehyde addition condensate is 1.2 to 30.

12. An aqueous coal slurry according to claim 1, wherein said coal powder has such a particle size that 70 to 80% of the powder pass through a 200-mesh sieve.

* * * * *